US005947269A

United States Patent [19]

Miyashita

[11] Patent Number: 5,947,269

[45] Date of Patent: Sep. 7, 1999

[54] PUSH BUTTON SWITCH

[75] Inventor: Isao Miyashita, Yamanashi-ken, Japan

[73] Assignee: Citizen Electronics Co., Ltd., Fujiyoshida, Japan

[21] Appl. No.: 09/178,556

[22] Filed: Oct. 26, 1998

[30] Foreign Application Priority Data

Nov. 7, 1997 [JP] Japan ..... 9-320575

[51] Int. Cl.[6] ..... H01H 5/20

[52] U.S. Cl. ..... 200/407; 200/406

[58] Field of Search ..... 200/402, 405, 200/406, 408, 449, 275

[56] References Cited

U.S. PATENT DOCUMENTS 3,941,964 3/1976 Yoder ..... 200/159 A
3,996,429 12/1976 Chu et al. ..... 200/5 A
4,129,763 12/1978 Murata ..... 200/159 A
4,484,042 11/1984 Matsui ..... 200/67

*Primary Examiner*—Lincoln Donovan
*Assistant Examiner*—Nhung Nguyen
*Attorney, Agent, or Firm*—Dennison, Meserole, Scheiner & Schultz

[57] ABSTRACT

In a push button switch, a movable contact plate has an upwardly arcuated movable contact, a pair of side plates at both sides of the movable contact, each side plate has a plurality of downwardly projected permanent contacts, and each of the permanent contacts has a most lower point, a fixed contact plate comprises a pair of first fixed contacts contacted with the most lower points of the permanent contacts, and a second fixed contact disposed between the first fixed contacts, so as to be contacted with the movable contact.

5 Claims, 4 Drawing Sheets

PUSH BUTTON SWITCH

BACKGROUND OF THE INVENTION

The present invention relates to a push button switch which may be used for an audio device mounted on a motor vehicle, camera, facsimile receiver, VTR device, and others.

FIG. 5 is a sectional view showing a conventional push button switch disclosed in the publication of Japanese Utility Model Laid Open 58-135830, and FIG. 6 is a plan view showing an internal structure of the switch. The switch comprises a case 1, movable contact plate 7 provided in the case 1, fixed contact plate 7*a* embedded in the bottom of the case 1, and push button 3.

The fixed contact plate 7*a* comprises a U-shaped first plate 7*b* and a straight second plate 7*c*. The first plate 7*b* has a pair of exposed first fixed contacts 4*a* and 4*b*, and the second plate 7*c* has an exposed second fixed contact 5*a*. The first plate 7*b* has a terminal 4, and the second plate 7*c* has a terminal 5.

As shown in FIG. 7, the movable contact plate 7 comprises an upwardly arcuated movable contact 10, a pair of side plates 11*a* and 12*a*, having downwardly arcuated permanent contacts 11 and 12, respectively. Each of the contacts 11 and 12 permanently contacts with one of the first fixed contacts 4*a* and 4*b*. A pair of slits 8 and 9 are formed between the movable contact 10 and the side plates 11*a* and 12*a*, and connecting portions 13 and 14 are provided at both ends.

The push button 3 has a spherical projection 3*b* at the underside thereof, contacting with the movable contact 10. The push button 3 is upwardly urged by the movable contact 10 and projected from a cover 2 through a window of the cover, so that a flange 3*a* is pressed against the underside of the cover 2.

When the push button 3 is depressed by a finger of a user, the movable contact 10 of the movable contact plate 7 is pushed down to the horizontal position. However, the shape of the other portions except for the movable contact 10 is not changed. When the movable contact 10 passes the horizontal neutral position, the movable contact 10 is inverted into the reverse arcuated position with a click, so that the contact 10 contacts with the second fixed contact 5*a*. Thus, the switch is closed. When the finger of the user is detached from the push button 3, the movable contact 10 returns to the initial position so that the switch is opened.

In such a push button switch, it is necessary that the movable contact 10 is instantaneously inverted with a click. To this end, other portions than the movable contact must be securely held, and must have sufficient stiffness. However, each of the contacts 11 and 12 has the same thickness as the movable contact 10 and has stiffness approximately equal to that of the movable contact 10. Therefore, when the push button 3 is depressed, the contacts 11, 12 are slightly extended to absorb a part of the depressing force. The inversion action of the movable contact 10 is accordingly dulled. By repeatedly using the push button switch, the fatigue of the contacts 11, 12 increases, thereby aggravating the function of the switch.

There is a further problem that the contacting pressure of the contacts 11 and 12 against the first fixed contacts 4*a* and 4*b* is low because of the plane contact there-between, which decreases the reliability of the electric conductivity.

Japanese Utility Model Laid Open 59-23119 discloses a movable contact plate for resolving the above described problems. FIG. 8 is a perspective view of the movable contact plate. In the contact plate, each of the bending lines 15, 16, 17 and 18 of the contacts 11 and 12 is inclined angle e with respect to the outside edge. Consequently, the stiffness of the contacts 11, 12 somewhat increases compared with the contacts of FIG. 7, and the contact area of each contact, becomes smaller because the surface of the contact is inclined with respect to the first fixed contact 4*a* (4*b*). However, the effect is not satisfactory for the push button switch.

In addition, the width W2 of the fixed contact plate 7*a* must be larger than the width W1 of the movable contact plate 7.

SUMMARY OF THE INVENTION

An object of the present invention is to provide a push button switch having a movable contact plate having a sufficient high stiffness and a small contact area.

According to the present invention, there is provided a push button switch having a case, a movable contact plate and a fixed contact plate provided in the case, and a push button, the switch comprising, the movable contact plate having an upwardly arcuated movable contact provided for upwardly urging the push button, and a pair of side plates at both sides of the movable contact interposing slits there-between respectively, each of the side plates having a plurality of downwardly projected permanent contacts, each of the permanent contacts having a most lower point, the fixed contact plate comprising a pair of first fixed contacts contacted with the most lower points of the permanent contacts, and a second fixed contact disposed between the first fixed contacts and separated from the first contact, and provided to be contacted with the movable contact.

Each of the permanent contacts has a semiconical shape, and the most lower point is provided on a bottom edge of the semiconical shape.

Furthermore, the permanent contacts are alternately arranged so that the most lower points are alternately disposed on the inside edge of the side plate.

The first fixed contacts are provided to be contacted with the most lower points located on the inside edge of the side plate.

These and other objects and features of the present invention will become more apparent from the following detailed description with reference to the accompanying drawings.

DETAILED DESCRIPTION OF THE PREFERRED EMBODIMENTS

Figure 5:
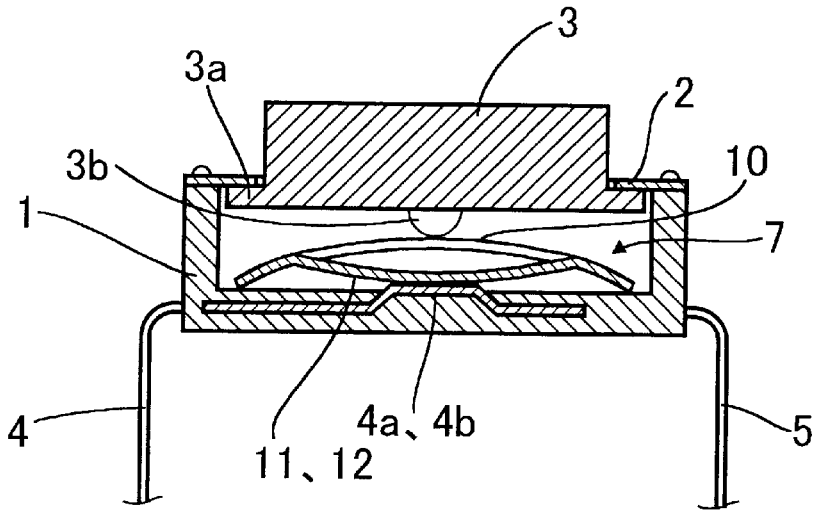
FIG. 5 PRIOR ART
FIG. 5 is a sectional view showing a conventional push button switch.
Figure 6:
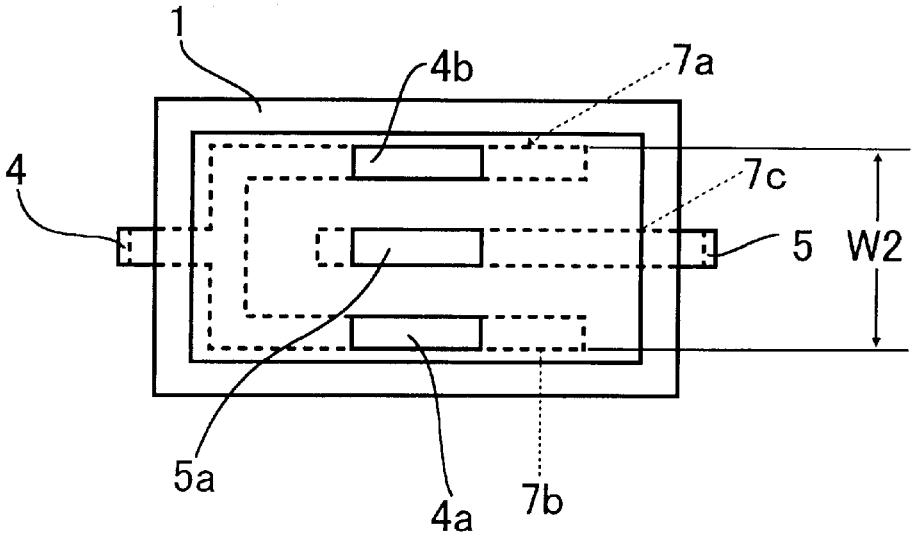
FIG. 6 PRIOR ART
FIG. 6 is a plan view showing an internal structure of the switch.
Figure 7:
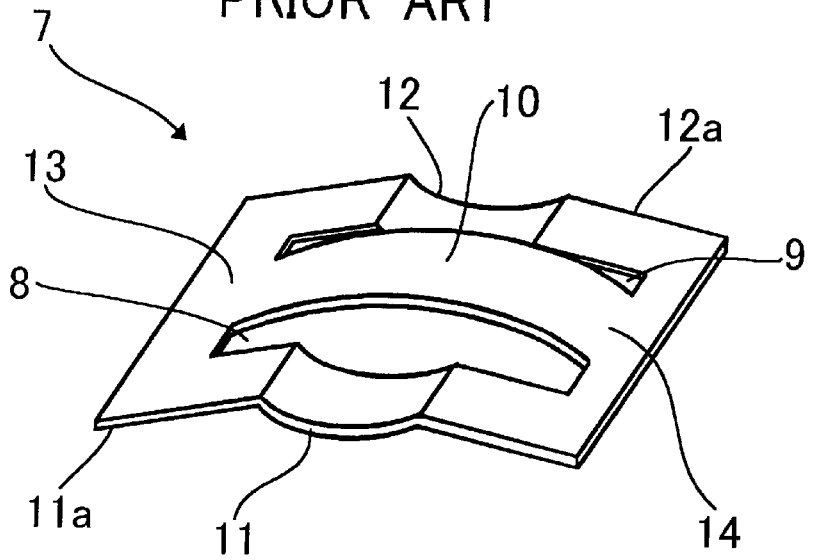
FIG. 7 PRIOR ART
FIG. 7 is a perspective view of a movable contact plate.
Figure 8:
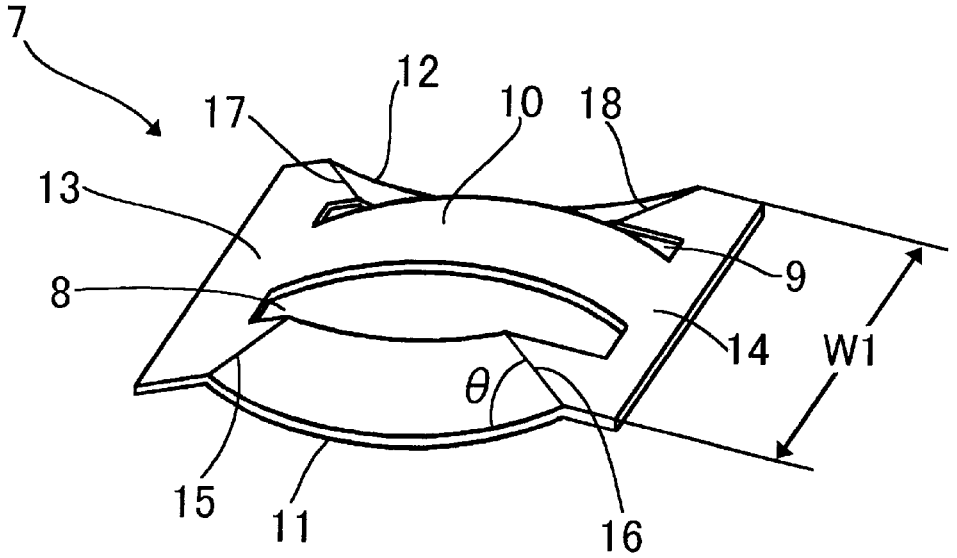
FIG. 8 PRIOR ART
FIG. 8 is a perspective view showing another conventional movable contact plate.

The push button switch of the present invention will be described hereinafter with reference to FIGS. 1 to 4. The same parts as FIGS. 5 to 7 are identified with the same reference numerals as the drawings.

Figure 1:
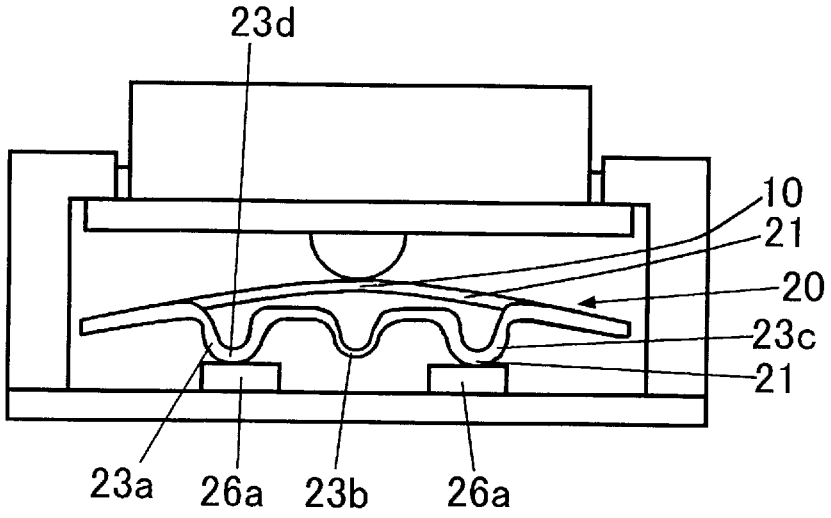
FIG. 1 is a sectional view showing an embodiment of the present invention.
Figure 3:
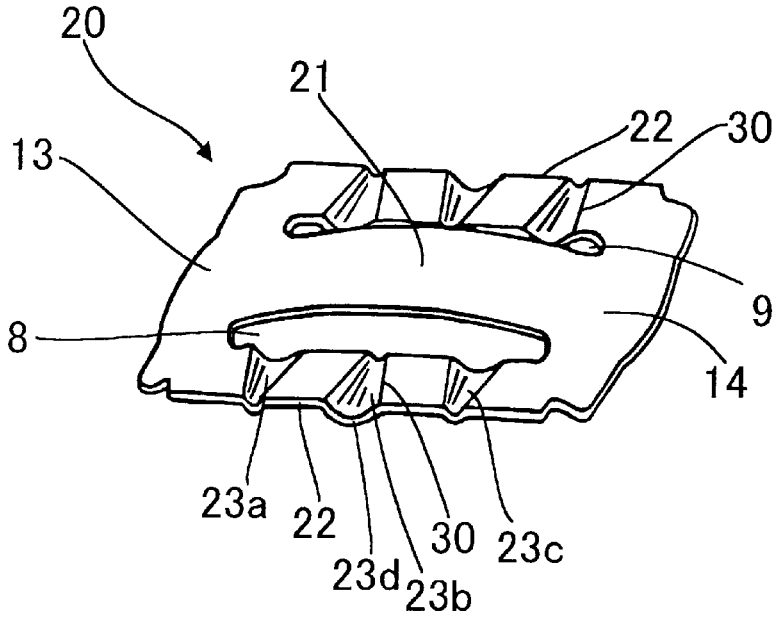
FIG. 3 is a perspective view of a movable contact plate.
Figure 4:
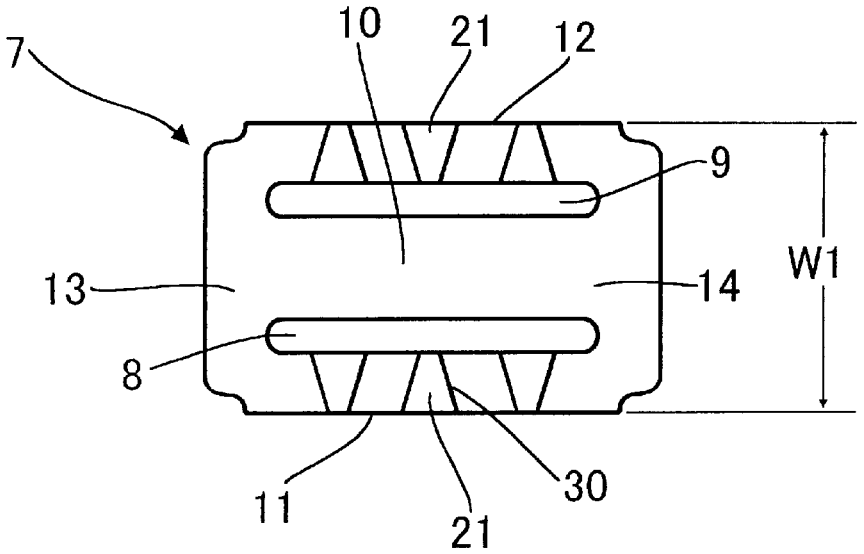
FIG. 4 is a plan view of the movable contact plate.

As shown is FIGS. 1 and 3, a movable contact plate 20 comprises an upwardly arcuated movable contact 21, and a pair of side plates 22. Each side plate 22 has three downwardly projected permanent contacts 23*a*, 23*b* and 23*c*. Each of the permanent contacts 23*a* to 23*c* has a semiconical shape which is formed by cutting in half a truncated corn. Therefore, a bottom edge is a most lower point 23*d*. The contacts 23*a* to 23*c* are alternately arranged so that the most lower points 23*d* of the contacts 23*a* and 23*c* are located on the inside edge of the side plate 22, and the most lower point 23*d* is located on the outside edge of the side plate 22.

Figure 2:
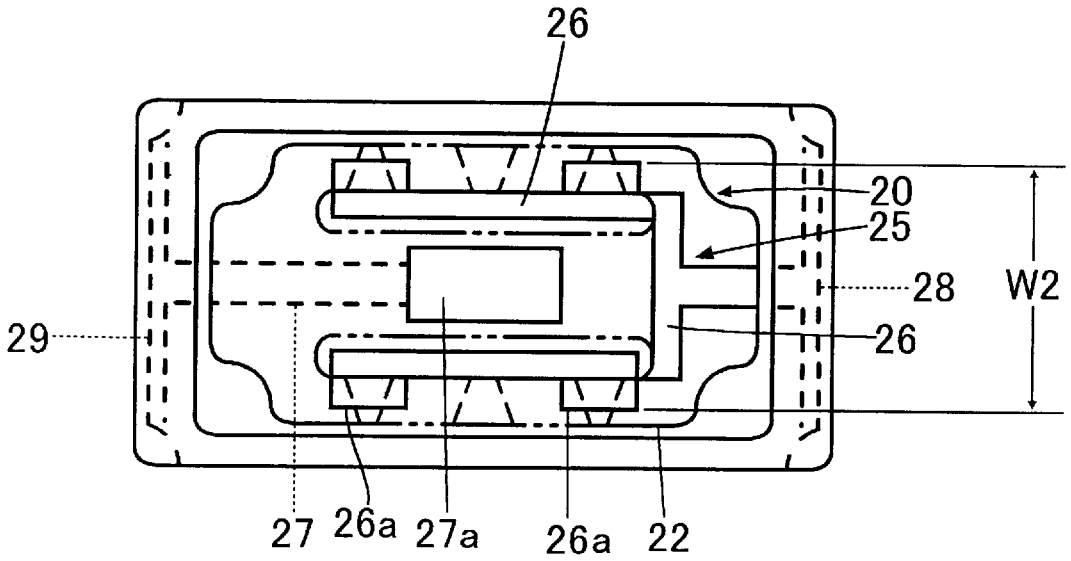
FIG. 2 is a plan view showing an internal structure.

Referring to FIGS. 1 and 2, a fixed contact plate 25 has a U-shaped first plate 26 and a central second plate 27. The each first plate 26 has a pair of projected first fixed contacts 26*a*, and the second plate 27 has a projected second fixed contact 27*a*. The first fixed contacts 26*a* is located corresponding to contacts 23*a* and 23*c* so that the most lower points 23*d* are permanently engaged with the first fixed contacts 26*a* as shown in FIG. 1.

The first fixed contacts 26*a* are connected to a terminal 28, and the second fixed contact 27*a* is connected to a terminal 29.

The operation of the switch of the present invention is the same as that of the conventional switch.

Since the radius of the bottom edge of the most lower point 23*d* is small, the contact area of the point 23*d* with the fixed contact is very small. In addition a plurality of inclined edges 30 of the contacts 21 increase the stiffness of the side plate 22. Thus, the reliability of the electric conductivity remarkably increases.

Since the width W2 of the fixed contact plate 25 can be made smaller than the width W1 of the movable contact plate 20, the size of a lower part of the push button switch can be reduced.

Although each of the permanent contacts 23*a* to 23*c* has a truncated corn, another shape such as a semi-spherical projection can be employed.

While the invention has been described in conjunction with a preferred specific embodiment thereof, it will be understood that this description is intended to illustrate and not limit the scope of the invention, which is defined by the following claims.

What is claimed is:

1. A push button switch comprising a case; a movable contact plate; a fixed contact plate provided in the case; and a push button, wherein the movable contact plate has an upwardly arcuated movable contact provided for upwardly urging the push button, and a pair of side plates at both sides of the movable contact with interposing slits therebetween;

each of said side plates has a plurality of downwardly projected permanent contacts, each of the permanent contacts has a most lower point;

the fixed contact plate includes a pair of first fixed contacts contacted with the most lower points of the permanent contacts, and a second fixed contact disposed between the first fixed contacts and separated from the first contact so as to be contacted with the movable contact;

each of the permanent contacts has a semi-conical shape, with the most lower point being provided on a bottom edge of the semi-conical shape, and the permanent contacts are alternately arranged so that the most lower points are alternately disposed on an inside edge of the side plate.

2. The push button switch according to claim 1 wherein the most lower point is formed on a semicircular sectional line.

3. The push button switch according to claim 1 wherein the first fixed contacts are provided to be contacted with the most lower points located on the inside edge of the side plate.

4. A push button switch comprising a case; a movable contact plate; a fixed contact plate provided in the case; and a push button, wherein the movable contact plate has an upwardly arcuated movable contact provided for upwardly urging the push button, and a pair of side plates at both sides of the movable contact with interposing slits therebetween;

each of said side plates has a plurality of downwardly projected permanent contacts, each of the permanent contacts has a semi-conical shape provided so that a most lower point is on a bottom edge of said semi-conical shape;

the fixed contact plate has a pair of first fixed contacts contacted with the most lower points of the permanent contacts, and a second fixed contact disposed between the first fixed contacts and separated from the first contact so as to be contacted with the movable contact.

5. The push button switch according to claim 4 wherein an axis of the semi-conical shape extends in a width direction of the side plate.

* * * * *